US005243905A

United States Patent [19]

Webber

[11] Patent Number: 5,243,905

[45] Date of Patent: Sep. 14, 1993

[54] STENCIL SYSTEM FOR APPLYING A DECORATIVE COATING ATOP A SUBSTRATE AND PROCESS

[76] Inventor: Ronald E. Webber, Box 25544, Sarasota, Fla. 34288-544

[21] Appl. No.: 866,330

[22] Filed: Apr. 9, 1992

[51] Int. Cl.[5] ..... B05C 17/06

[52] U.S. Cl. ..... 101/128; 101/112; 118/301; 118/504

[58] Field of Search ..... 101/128, 112; 118/301, 118/504; 33/562, 565; 249/203, 187.1

[56] References Cited

U.S. PATENT DOCUMENTS

| | | | |
|---|---|---|---|
| 87,727 | 3/1869 | Tarbox et al. | 101/128 |
| 1,708,968 | 4/1929 | Gianelloni, Jr. | 101/128 |
| 2,595,142 | 4/1952 | Herck | 33/562 X |
| 2,616,145 | 11/1952 | Dufford | 101/128 X |
| 3,678,887 | 7/1972 | Smith | 118/504 |
| 4,080,742 | 3/1978 | Osterried | 33/565 X |
| 4,930,413 | 6/1990 | Jaffa | 101/127 X |
| 5,038,714 | 8/1991 | Dye et al. | 118/301 X |

*Primary Examiner*—Edgar S. Burr
*Assistant Examiner*—John S. Hilten
*Attorney, Agent, or Firm*—Charles J. Prescott

[57] ABSTRACT

A stencil system and process for applying a decorative coating atop a substrate surface. The stencil system includes a plurality of stencils connectable in an array used in the process and structured to lay interconnected atop the substrate without relative movement and to uniformly and completely shield a decorative or geometric pattern defined on the substrate from being coated by the array of stencils. Thus, a liquid cement-like coating, preferably sprayed over the substrate to a thickness generally equal to that of the stencils, will cure and harden after removal of the stencils, to create a decorative simulated stone, brick, tile or the like surface appearance.

3 Claims, 2 Drawing Sheets

STENCIL SYSTEM FOR APPLYING A DECORATIVE COATING ATOP A SUBSTRATE AND PROCESS

BACKGROUND OF THE INVENTION

This invention relates generally to simulated and textured exterior and interior floor and driveway surfaces, and more particularly to a system and process for applying a concrete like decorative surface atop an existing substrate such as floorings, driveways, patios, pool decking, decorative walls and the like.

Considerable effort has been expended in developing various products and methods for enhancing the decorative appearance of conventional flooring and concrete surfaces such as driveways, patios, pool decking and the like. A simple and conventional method of accomplishing this is to cement or epoxy relatively thin slices of the desired decorative material directly atop the existing unornamental substrate. However, this procedure is relatively expensive with respect to cost of material and is labor intensive.

Applicant is aware of a marbleizing process disclosed in U.S. Pat. No. 4,721,634 to McKinnon. However, this invention does not produce regular geometric shapes defined by simulated grouting therebetween.

A most economical way to apply a concrete-like coating such as an acrylic cement coating atop a substrate is through spraying techniques. Of course, unless a desired pattern of this substrate is protected, the entire surface will be coated with this material during the spraying operation.

One means of creating a decorative or geometric pattern in conjunction with this spraying technique to simulate a grout or mortar effect is by simply applying a tape design atop the substrate surface prior to spraying. The tape design may be so as to create a simulated brick, tile, sharpstone pattern or the like. In such a procedure, the tape would be adhered directly to the substrate in the desired pattern and then a desired cement coating of any given color combination may be applied atop the entire substrate surface, including the taped design. Shortly thereafter, the tape must be removed prior to initial curing of the coating, then allowing the coating to completely harden and cure. This taping process is extremely labor intensive at best, may require artistic talents of the applicator for design creation, and represents a time-consuming removal process of the tape after cement coating spraying.

The present invention provides a stencil system and process for creating a decorative concrete sprayed surface atop a substrate which is uniform in any pattern desired, is easy to install and remove, assists in defining the thickness of the coating applied and is reusable almost indefinitely, except for breakage.

BRIEF SUMMARY OF THE INVENTION

This invention is directed to a stencil system and process for applying a decorative coating atop a substrate surface. The stencil system includes a plurality of stencils connectable in an array used in the process and structured to lay interconnected atop the substrate without relative movement and to uniformly and completely shield a decorative or geometric pattern defined on the substrate from being coated by the array of stencils. Thus, a liquid cement-like coating, preferably sprayed over the substrate to a thickness generally equal to that of the stencils, will cure and harden after removal of the stencils, to create a decorative simulated stone, brick, tile or the like surface appearance.

It is therefore an object of this invention to provide a stencil system which may be easily deployed atop a substrate and interconnected in an array with sufficient relative immobility thereafter so as to protectively conceal a predetermined decorative pattern on the substrate from a concrete-like spray coating applied atop the entire arrangement.

It is yet another object of this invention to provide a stencil system as above described which is easily washable and reusable.

It is yet another object of this invention to provide a stencil system as above described which may be used to define the thickness of decorative coating applied atop the substrate.

It is yet another object of this invention to provide a stencil system as above described in a virtually limitless number of decorative geometric and irregular patterns as desired.

It is yet another object of this invention to provide a process, in conjunction with the above stencil system, for applying a decorative coating atop a substrate which simulates a grouted surface.

In accordance with these and other objects which will become apparent hereinafter, the instant invention will now be described with reference to the accompanying drawings.

DETAILED DESCRIPTION OF THE INVENTION

Figure 1:
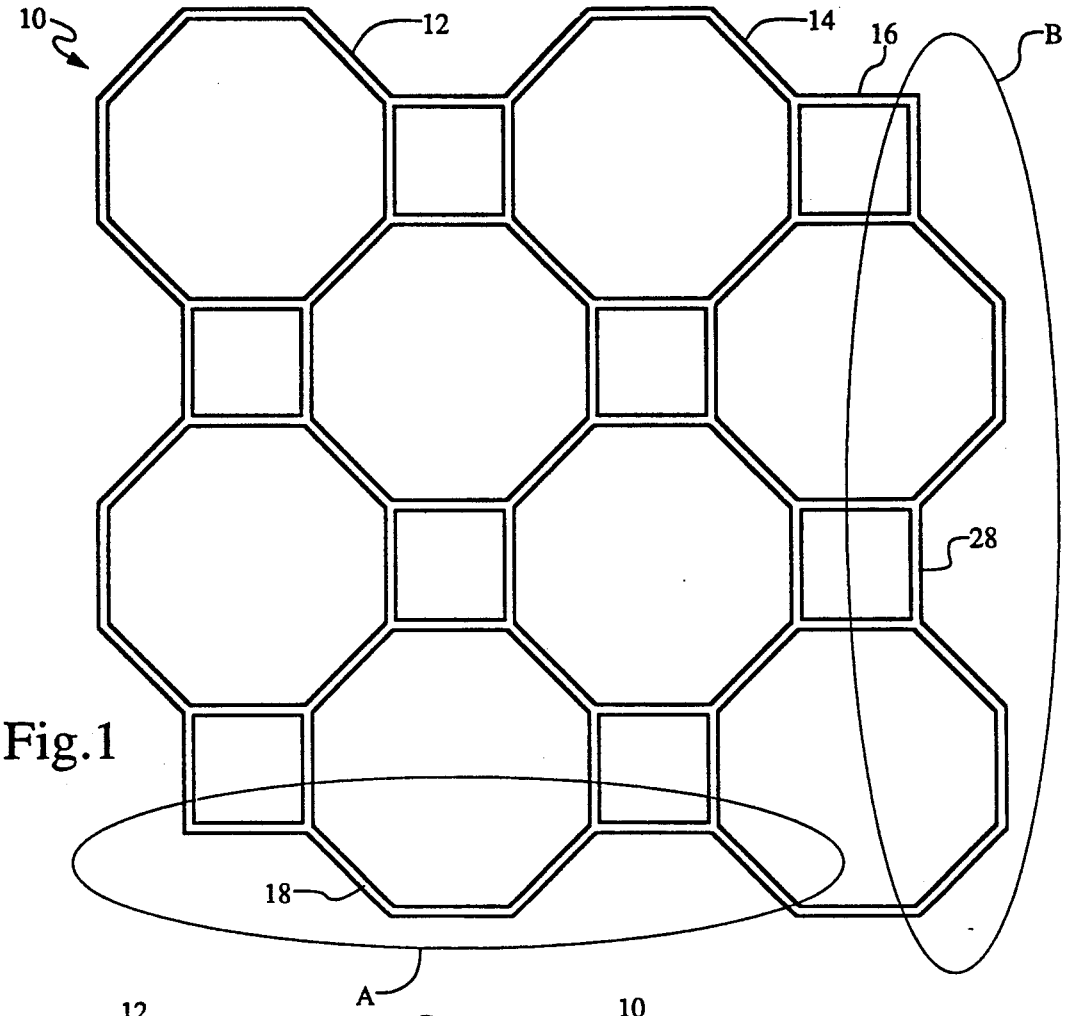
FIG. 1 is a top plan view of one embodiment of the invention.
Figure 3:
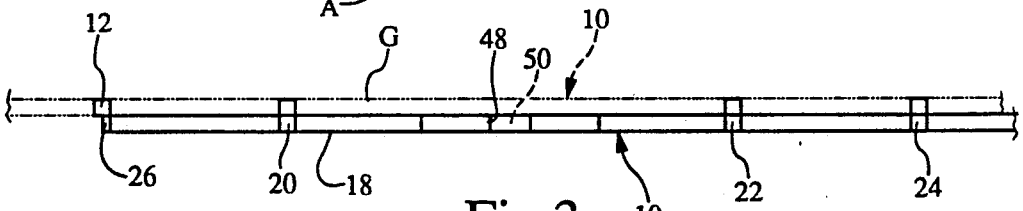
FIG. 3 is an end elevation view in the direction of arrows 3—3 in FIG. 2.
Figure 4:
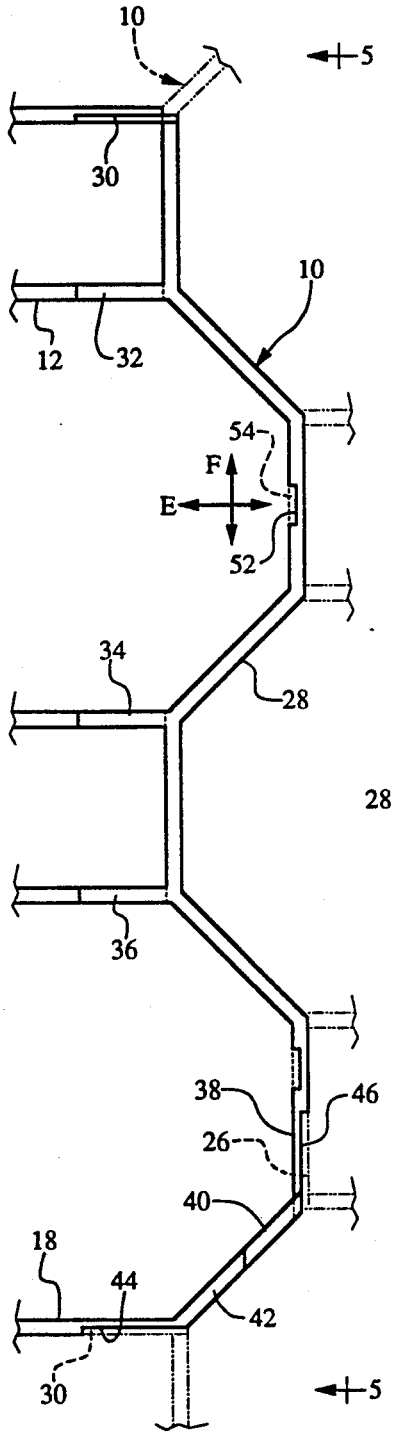
FIG. 4 is an enlarged view of region B in FIG. 1.
Figure 5:
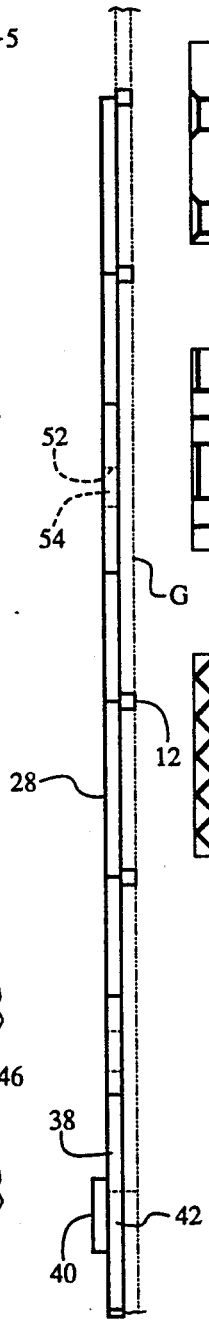
FIG. 5 is an end elevation view in the direction of arrows 5—5 in FIG. 4.
Figure 6:
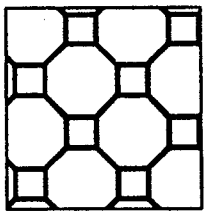
FIGS. 6 through 12 are top plan views of a portion of a completed decorative surface applied to a substrate in various geometric and irregular patterns to demonstrate the versatility of this invention.
Figure 7:
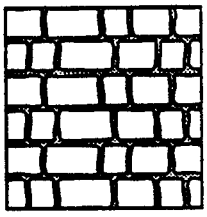
Figure 8:
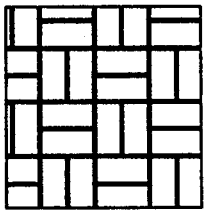
Figure 9:
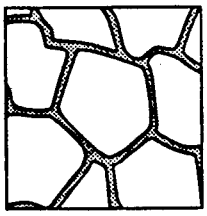
Figure 10:
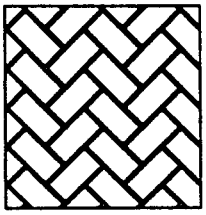
Figure 11:
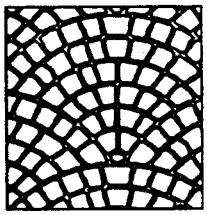
Figure 12:
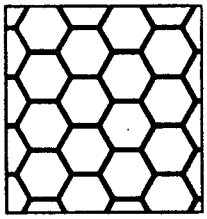

Referring now to the drawings, and particularly to FIGS. 1 to 5, one embodiment of a stencil as part of a stencil system and as utilized in the process of the invention is shown generally at numeral 10. The system of the invention includes a plurality of such stencils 10 which are lockingly and self-aligningly interengagable atop a substrate as described herebelow. This stencil 10 is fabricated from three separate sheets of in the range of 3/32 to 1/8 inch thick transparent LEXAN polycarbonate material 12, 18 and 28 which define an array of hexagons 14 and rectangles 16 as best seen in FIG. 1. Each of these stencil portions 12, 18 and 28 are fabricated using a numerical controlled router cutting from a full sheet of LEXAN material. Thereafter, these stencil portions 12, 18 and 28 are adhesively bonded as with cryacyanate or "instant adhesive" as best seen in FIGS. 3 to 5.

The main stencil portion 12 is adhered to stencil portion 18 at overlapping areas 20, 22, 24 and 26, while the stencil portion 28 is adhered to the main stencil portion 12 at overlapping areas 30, 32, 34, and 36. The mating ends of stencil portions 18 and 28 are butted together and connected by splice 40.

A primary feature of the stencil system of the present invention is that each of the stencils 10 may be interlockingly, self-alignigly positioned adjacent one another so as to define a continuous, unbroken pattern atop a substrate shown in phantom at G. By the interlocking arrangement described below, the stencils 10 are unable to move in any direction one to another during the coating application process.

Figure 2:
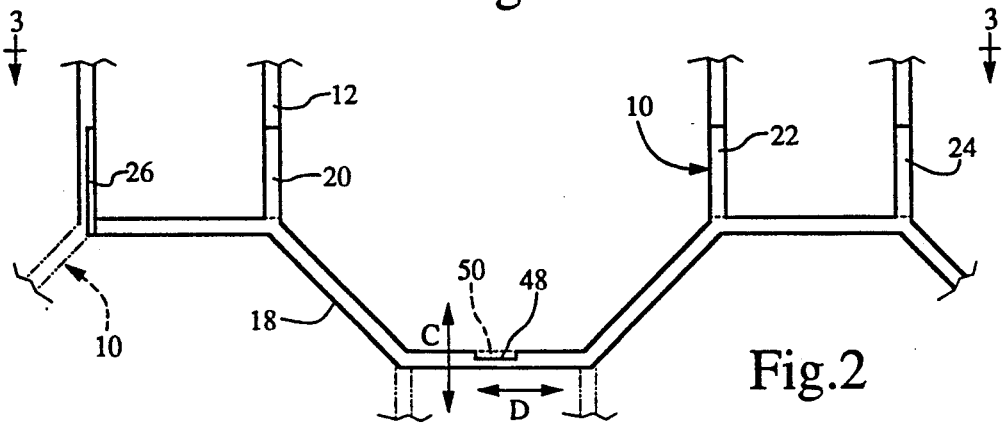
FIG. 2 is an enlarged view of region A in FIG. 1.

To accomplish this interlocking feature, the two adjacent regions A and B as seen in FIG. 1 are structured as shown in FIGS. 2 to 5. In FIGS. 2 and 3, region A includes a half width segment 26 of stencil portion 18, which, in its entirety, is elevated above the substrate surface G a distance equal to the thickness of the next adjacent overlapping corresponding margin of the stencil shown at 10 in phantom. To prevent separation between adjacent stencils 10 in the direction of either arrow C or D, one or more notches 48 are formed along an inner edge of stencil portion 18 which exactly mate with one or more tabs 50 (in phantom) adhered along a corresponding outer edge of main stencil portion 12.

In FIGS. 4 and 5, the modification to region B is there shown along this margin. Segment 30 is half the width of the corresponding overlapping portion of stencil portion 12 so that it will mate at 30 shown in phantom in notch 44 formed into stencil portion 18. Likewise, notch 46 formed at the lower end of stencil portion 28 is provided to mate with section 26 of stencil portion 18 of the next abutting stencil 10. To prevent separation between adjacent stencils 10 in the direction of either arrow E or F, one or more notches 52 are formed along an inner edge of stencil portion 28 which exactly mate with one or more tab 54 (in phantom) adhered along a corresponding outer edge of main stencil portion 12.

By this arrangement, when each of the stencils 10 are properly positioned in an array adjacent one another, both relative linear and rotational movement are virtually eliminated during the coating spraying process.

PROCESS

The process of the present invention wherein a liquid cement-like coating is applied as preferably in spraying atop a substrate surface utilizing the stencil system as previously described is as follows.

The substrate is first cleaned, if not a virgin surface, and then acid washed and rinsed thoroughly with fresh water to remove all residue and debris. An optional step at this point after dry is to apply a colored stain to the substrate which will contrast in color from the cement-like coating next applied. This colored stain will have the later appearance of grouting. Alternately, a concrete colored acrylic mortar may be trowled, squeegied or sprayed over the substrate so as to create an alternate grout joint effect.

Whether any such grouting coating is applied, the array of stencils are then laid atop the prepared substrate. Note that, because each stencil 10 is fabricated of relatively thin (approximately ⅛ inch) LEXAN polycarbonate, any irregularities in the flatness of the substrate are easily accommodated by flexure of the stencils 10. Additionally, where the substrate approaches an upright wall surface, the flexibility afforded by the polycarbonate stencil 10 facilitates extreme manual bending of the template 10 into almost full compliance against substrate nearly up to the wall area.

After the array of stencils 10 are in place and interlocked as previously described, a liquid cement-like acrylic coating is then sprayed over the entire surface, including the array of stencils 10. The thickness of build-up of the spray coating is regulated to generally equal the thickness of the stencils 10. However, an experienced applicator may vary this either thicker or thinner than that of the stencils 10 as desired.

It is here noted that all of the predetermined decorative pattern to be applied atop the substrate will be covered by the interlocking array of stencils 10 so that there will be absolutely no gaps left to be repaired or touched up in the grouting pattern after removal of the stencils 10.

An optional but preferred step after the spray application of the cement coating is the manual brushing of the coating surface, particularly along the margins of the stencils 10. This manual brushing as with a broom or soft bristled brush rounds the edges of the coating material immediately along the margins of the stencils 10 and varies surface texture.

After the coating material has begun to harden and cure, the stencils 10 may then be lifted, removed and cleaned for reuse. It is at this point during the curing process of the coating that an optional colored stain may be applied most effectively, if desired. This follow-up color staining serves as a surface sealer as well.

The acrylic cement material requires approximately twenty eight (28) days for full curing and hardening. However, after approximately one to two days, the coating is sufficiently hard so as to be machine sandable, if desired. Machine sanding at this point exposes a portion of the surface only because of the irregular nature of the coating as applied, thus creating a two-tone shading or marbling effect. Thereafter, a clear stain may be applied so as to seal the entire surface.

FIGS. 6–12 are examples of the range of decorative effects which may be created by the present invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A stencil system for use in applying a decorative pattern of coating material atop a horizontal concrete or like surface comprising:

a plurality of stencils, each of said stencils being formed from a flat sheet of flexible material having a thickness generally equal to that of the coating material and also having an array of spaced openings through each said stencil defining said decorative pattern by a plurality of connected strips of said material;

each said stencil having integral self-aligning and interlocking notch and tab means for positioning, aligning and interlocking each two adjacent said stencils one to another when atop the concrete surface;

said notch and tab means being contained entirely within the plane of the stencil and sufficient to prevent relative movement in any horizontal direction between each said two adjacent interlocked stencils;

all said stencils cooperatively structured one to another whereby said plurality of strips are uniformly and continuously in contact with the concrete surface over the entire decorative pattern.

2. A stencil system as set forth in claim 1, wherein: said flexible material is polycarbonate.

3. A stencil system as set forth in claim 1, wherein: said decorative pattern is a repeating regular or irregular geometric pattern.

* * * * *